US005406245A

United States Patent [19]

Smith et al.

[11] Patent Number: 5,406,245

[45] Date of Patent: Apr. 11, 1995

[54] ARC-QUENCHING COMPOSITIONS FOR HIGH VOLTAGE CURRENT LIMITING FUSES AND CIRCUIT INTERRUPTERS

[75] Inventors: James D. B. Smith, Monroeville; William R. Crooks, Pittsburgh, both of Pa.

[73] Assignee: Eaton Corporation, Cleveland, Ohio

[21] Appl. No.: 109,890

[22] Filed: Aug. 23, 1993

[51] Int. Cl.[6] ..... H01H 85/38

[52] U.S. Cl. ..... 337/273; 337/276; 218/150

[58] Field of Search ..... 337/273, 276, 278, 279, 337/280; 200/144 C

[56] References Cited

U.S. PATENT DOCUMENTS

| | | | |
|---|---|---|---|
| 2,526,448 | 8/1949 | Amundson et al. . | |
| 3,242,291 | 3/1966 | Frink . | |
| 3,582,586 | 6/1971 | Jones . | |
| 3,716,514 | 2/1973 | Morello | 260/33.4 P |
| 3,761,660 | 9/1973 | Jones | 200/144 C |
| 3,766,509 | 10/1973 | Cameron | 337/159 |
| 3,925,745 | 12/1975 | Blewitt | 337/279 |
| 4,008,452 | 2/1977 | Cameron | 337/284 |
| 4,035,755 | 7/1977 | Cameron | 337/280 |
| 4,099,153 | 7/1978 | Cameron | 337/159 |
| 4,166,266 | 8/1979 | Kozacka et al. | 337/158 |
| 4,167,723 | 9/1979 | Wilks | 377/273 |
| 4,179,677 | 12/1979 | Kozacka et al. | 337/161 |
| 4,251,699 | 2/1981 | Wiltgen, Jr. | 200/144 C |
| 4,307,368 | 12/1981 | Reid | 337/279 |
| 4,309,684 | 1/1982 | Wilks | 337/273 |
| 4,319,212 | 3/1982 | Leach | 337/159 |
| 4,339,742 | 7/1982 | Leach et al. | 337/79 |
| 4,340,790 | 7/1982 | Boliver | 200/144 |
| 4,444,671 | 4/1984 | Wiltgen, Jr. | 200/144 |
| 4,520,337 | 5/1985 | Cameron | 337/275 |
| 4,625,195 | 11/1986 | Robbins | 337/159 |
| 4,638,283 | 1/1987 | Frind et al. | 337/162 |
| 4,778,958 | 10/1988 | Mayer et al. | 200/144 |
| 4,808,963 | 2/1989 | Stunzl et al. | 337/246 |
| 4,950,852 | 8/1990 | Goldman et al. | 200/144 |
| 4,952,900 | 8/1990 | Cameron et al. | 337/217 |
| 4,975,551 | 12/1990 | Syvertson | 200/144 C |
| 4,995,886 | 2/1991 | Cameron et al. | 337/217 |

*Primary Examiner*—Lincoln Donovan
*Attorney, Agent, or Firm*—Martin J. Moran

[57] ABSTRACT

Arc-quenching coating compositions are provided with effective arc-extinguishing properties and improved track resistance properties, and are relatively easy to apply in liquid form. The coating compositions are used, for example, in high voltage current limiting fuses, expulsion fuses, circuit breakers, circuit interrupters, separable cable connectors, or the like for interrupting circuits. The arc-quenching coating compositions include an arc-quenching gas-evolving material (A) and a film-forming polymer (B) having minimal tracking properties, in which the film-forming polymer (B) acts as a liquid vehicle for the coating composition. The arc-quenching material (A) is preferably selected from the group of guanidine, guanidine carbonate, guanidine acetate, 1,3-diphenylguanidine, guanine, melamine, melamine cyanurate, urea, hydantoin, allantoin and derivatives and mixtures thereof. The film-forming polymer (B) is preferably selected from the group of urethane, acrylic, melamine-formaldehyde polymers and derivatives and mixtures thereof. Arc-quenching compositions are also provided with effective arc-extinguishing properties, improved non-tracking properties, and thermal stability, and the compositions are selected from the group of gas-evolving materials (A) of guanidine carbonate, guanidine acetate, 1,3-diphenylguanidine, guanine, melamine cyanurate, urea, hydantoin and allantoin.

20 Claims, 2 Drawing Sheets

ARC-QUENCHING COMPOSITIONS FOR HIGH VOLTAGE CURRENT LIMITING FUSES AND CIRCUIT INTERRUPTERS

BACKGROUND OF THE INVENTION

1. Field of the Invention

The invention relates to the field of high voltage circuit interruption in electrical devices such as switchgears, transformers, and the like, and in particular concerns high voltage current limiting fuses or expulsion fuses, circuit breakers, circuit interrupters, separable cable connectors, or the like, comprising an arc-quenching composition which is adapted to rapidly evolve a gas in the presence of an electric arc to aid in arc extinction, and thereby quickly and effectively break the circuit. More particularly, the invention is directed to arc-quenching coating compositions having excellent arc-quenching properties and improved track resistance properties that are relatively easy to apply and operationally position in high voltage current limiting fuses.

2. Prior Art

Expulsion fuses or gas-evolving fuses have been used extensively for high voltage circuit interruption in switchgears, transformers, and other electrical equipment. It is generally known that the use of arc-quenching or gas-evolving materials in such a circuit interruption device positioned in contact with the fusible element aids in, inter alia., deionizing, cooling, and thus quenching of the electric arc created under fault current conditions.

A typical high voltage fuse comprises a generally tubular casing of electrical insulating material; a pair of terminal elements closing each of the opposite ends of the casing; a pulverulent arc-quenching filler material of high dielectric strength inside the casing such as sand, mica beads, or finely divided quartz; a fusible element or elements made of a highly conductive material such as silver submersed in the filler and conductively interconnecting the terminal elements, the fusible elements typically being wound in a parallel-connected relationship along the length of a supporting core; a core of high dielectric strength electrically insulating high temperature material such as ceramic, the core providing support for the fusible element by longitudinally and radially extending, i.e., providing fins having a cross-shaped, star-shaped or the like cross-section, along the longitudinal axis of the casing; and a gas-evolving material distributed along the length of the core or comprising part of the core itself in contact with the fusible element or elements.

In operation, when the high voltage current limiting fuse is subjected to an applied current that exceeds the current carrying capability of the fusible element, the excessive current generates heat whereby the fusible element attains a fusion temperature which initiates melting and vaporization of the fusible element. Electrical arcing thereby occurs as the fusible element or metal vapors rapidly expand to many times the volume originally occupied by the fusible element. These vapors, therefore, expand into the space between the filler material where they condense through heat transfer into the filler and are no longer available for current conduction. In addition, the gas-evolving material distributed along the length of the core or comprising part of the core is adapted to rapidly evolve a gas during arcing and thereby produce a deionizing action and a cooling effect on the arc, which facilitates arc extinction and also reduces the occurrence of restriking and tracking, i.e., fuse conduction after the interruption of the overload current.

A good arc-extinguishing material must be capable of rapidly generating a large volume of non-combustible and non-toxic gas within a short time after the arc has been struck. The arc-extinguishing material and its solid residue in a fused state must be relatively non-conductive so as to prevent restriking or tracking of the arc by conductance through the fused compound, thereby avoiding re-establishing a current flow through the material after interruption. In addition, the arc-extinguishing material must be relatively insoluble in water so that it will not be affected by water present in the atmosphere. Furthermore, the arc-extinguishing material should be moldable or positionable into a self-sustaining structure without large mounts of inert binder.

The art has been focused on formulating arc-quenching compositions which are easily molded into strong self-sustaining structures and then installed in a fuse or circuit interruption device. For example, U.S. Pat. No. 4,339,742—Leach et al. disclose a high voltage fuse having a plurality of block-shaped gas-evolving members attached to a plurality of fuse elements wound about a supporting core. The structural gas-evolving members are fabricated with narrow slits to easily mount to the fuse elements at desired locations.

U.S. Pat. No. 4,166,266—Kozacka et al. disclose an electric fuse having a core for supporting the fusible elements made of a longitudinally extending structural gas-evolving rod. U.S. Pat. No. 4,625,195—Robbins discloses an electric fuse having positioning means on the core to engage a gas-evolving structural member having a lateral protrusion integrally formed on the surface of the gas-evolving member. See, for example, U.S. Pat. Nos. 3,582,586; 3,761,669; 4,251,649; 4,340,790; and, 4,444,671 for more structural applications of arc-quenching or gas-evolving compositions.

However, these arc-quenching self-sustaining strong structural materials suffer from disadvantages. The conventional self-sustaining arc-quenching materials having high physical strength comprise a gas-evolving material combined with a thermoplastic or thermosetting polymeric binder. The binder compositions, although providing physical strength and moldability to the generally weak arc-quenching materials to form self-sustaining arc-quenching structural materials, are generally highly carbonizing materials. Therefore, upon arcing conditions, the binder decomposes and forms conductive carbon residues in the circuit interruption device which thereby causes undesirable tracking and restriking of the arc.

As appreciated in the art, typical arc-quenching materials alone are structurally complex, difficult to manufacture into satisfactory structural shapes, and, therefore, cannot be effectively installed in a high voltage current limiting device without this expensive structural modification of combining the arc-quenching material with a structural polymeric binder. The resulting carbonizing properties of the polymeric binder has been tolerated as an unavoidable by-product in order to improve the moldability and physical strength of the arc-quenching material.

Melamine and melamine derived nitrogen-containing compounds were first disclosed as effective arc-extinguishing materials in U.S. Pat. No. 2,526,448—Amundson et al. Melamine is a heterocyclic nitrogen compound containing a 1,3,5-triazine gas-evolving group. Melamine is a white crystalline powder having a melting point of about 345° C. and sublimes, i.e. its solid transforms directly to vapor without passing through its liquid phase, at its melting temperatures and below. Melamine has the following general chemical structure:

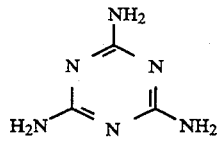

However, melamine and melamine derived nitrogen-containing compounds although having excellent arc-extinguishing abilities, have been discovered to be incapable of being fabricated, i.e., molded, extruded, etc., into satisfactory structural shapes and further lacked effectiveness at lower power conditions. Therefore, it became necessary in the art, as discussed generally above, to provide melamine in combination with a suitable organic binder in order to provide sufficient moldability and physical strength to the arc-extinguishing materials, such as improved tensile strength, percent elongation and the amount of energy required to rupture the product. The binder also provided lower power circuit interruption.

U.S. Pat. No. 3,582,586—Jones discloses an arc-interrupting composition comprising melamine and a thermoplastic organic polymeric binder which provides improved structural properties of the arc-quenching materials and effectiveness to arcing at lower amperage circuit interruption conditions, below which melamine was effective. Jones discloses that effective binders are thermoplastic resins including polyethylene, polypropylene, polytetrafluoroethylene, acrylic and acetal resins. Jones further discloses that another binder may be thermosetting resins including melamineformaldehyde resins.

These thermoplastic and thermosetting polymeric binders have been found useful generally in arc-interrupting compositions based upon melamine or related compounds because these binders volatilize in the presence of an electric arc at lower power conditions than necessary to sublime melamine which thereby produces large volumes of gas to drive the melamine into the core of the are and to extinguish the arc. In addition, the binders provide compositions with good molding and forming ability, stability and electrical insulating properties and physical strength.

However, the organic structural binders suffer from the disadvantage that they readily carbonize in air under arcing conditions. The arc-quenching compositions containing the organic structural binders typically have a high carbon content which therefore decomposes under arcing conditions to produce carbon residues. The carbon residues are conductive and therefore cause tracking of the are and create difficulties in quenching the arc. Furthermore, the compositions with binders are typically expensive to formulate and fabricate into the desired structural shapes for placement in the circuit interruption device. The binder must first be mechanically homogenized with the arc-quenching material by using plastic compounding energy consumptive techniques such as milling or the like, and then modified into desired shapes by using plastic processing techniques, such as injection/compression molding, extrusion, pultrusion and the like. Furthermore the mixing of the binder and the arc-quenching material may not provide optimal distribution of the arc-quenching material.

U.S. Pat. No. 3,761,660—Jones discloses an arc-interrupting composition having improved anti-tracking properties comprising melamine, hydrated alumina, and a thermoplastic organic binder. Jones discloses that the addition of hydrated alumina, $Al_2O_3.3H_2O$ provides non carbonizing properties to the arc-quenching composition which is attributed to its release of water of hydration for effective arc-quenching and to its catalyzing the oxidation of carbonaceous material to thereby cause a clean bum and prevent carbon deposits or residues on the arc exposure surfaces. Thus, the hydrated alumina reduces the tendency of the organic binder upon arcing conditions to carbonize on the surface of material and form a conductive path for are tracking. However, the use of hydrated materials in fuses leads to possible corrosion damage to the fuse components from the evolved water of hydration during arcing conditions.

Other examples of arc-quenching compositions comprising arc-quenching materials and organic binders are disclosed in the following publications. U.S. Pat. No. 4,251,699—Wiltgen, Jr. discloses another arc-quenching composition comprising dicyandiamide. Wiltgen, Jr. discloses that the dicyandiamide composition is typically provided in combination with an organic binder. However, dicyandiamide has a 210° C. melting point, lower than the melting point of melamine, and sublimes at its melting point and below. Therefore, dicyandiamide has a lower thermal stability than melamine and therefore tends to disassociate and evolve gases at lower than desirable conditions. Furthermore, the dicyandiamide contains a reactive cyano group in the molecule which produces toxic gas upon decomposition under arcing conditions. U.S. Pat. No. 4,444,671—Wiltgen, Jr. discloses an arc-extinguishing material comprising hexamethylenetetramine and binder.

U.S. Pat. No. 4,975,551—Syvertson discloses an arc-extinguishing composition comprising effective amounts by weight of an arc-extinguishing material, such as melamine, and a thermoplastic structural binding polymer, such as ethylene acrylic acid copolymer to achieve a combination of arc-extinguishing properties and improved structural characteristics, such as tensile strength, elongation, and environmental resistance to thermal cycling. The composition according to Syvertson includes an improved thermoplastic polymeric binder containing carboxylic acid moieties, such as ethylene acrylic acid, wherein the carboxylic acid moiety of the binder polymer is chemically bonded to an arc-extinguishing material, such as melamine, containing a carboxylic acid reactive group, such as amine, hydroxyl, epoxy, aziridine or thiol groups during structural molding of the arc-extinguishing composition under heat and pressure.

However, an arc-extinguishing composition according to Syvertson involves high material and fabrication costs to produce and further involves highly carbonizing carboxylic acid groups which in the fused state will likely form tracking conditions and create difficulties in quenching the arc.

SUMMARY OF THE INVENTION

In the design of high voltage current limiting fuses, circuit interrupters or the like, it would be desirable to provide arc-quenching compositions or gas-evolving materials that rapidly evolve gases under the action of an electric arc to quench the arc and that have minimal tracking properties, and that also have high thermal properties, high electrical insulation properties, and self-sustaining structural properties. It would also be desirable to provide a relatively inexpensive to manufacture and easy to install arc-quenching composition while maintaining the desirable arc-quenching properties, thermal properties, insulating properties and structural properties and especially the non-tracking properties. It would further be desirable to provide an arc-quenching material with improved are and track resistance.

It would also be desirable to provide an easy to apply arc-quenching coating composition, comprising: (A) an arc-quenching or gas-evolving material component and (B) a relatively non-tracking and non-conductive film-forming polymer component, wherein the film-forming polymer component (B) acts as a liquid vehicle for the coating composition. The arc-quenching coating composition according to the invention provides effective electric arc extinction by rapid evolution of non-conductive quenching gases and the arc-quenching coating composition exhibits high track resistance to surface breakdown caused by the electric are during fault current conditions.

It is an object of the invention to provide an arc-quenching coating composition that has sufficient structural strength, arc-extinguishing characteristics, non-tracking properties, thermal stability, and insulating properties that is relatively inexpensive and easy to manufacture and to install.

It is another object of the invention to provide an arc-quenching coating composition having improved track resistance properties.

It is another object of the invention to provide an arc-quenching coating composition with minimal carbon residue formation upon arcing and high temperature conditions.

It is a further object of the invention to provide an arc-quenching coating composition having relatively high gas-evolving capabilities to extinguish an arc.

It is a further object of the invention to provide an easy to apply and install arc-quenching coating composition.

It is a further object of the invention to provide an arc-quenching composition having effective arc-extinguishing characteristics, non-tracking properties, thermal stability, and insulating properties.

These and other objects are accomplished by an arc-quenching coating composition comprising an arc-quenching material (A) and a film-forming polymer (B) having minimal tracking properties, wherein the film-forming polymer (B) acts as a liquid vehicle for the coating composition.

The arc-quenching material (A) is selected from the group consisting of guanidine carbonate, guanidine acetate, 1,3-diphenylguanidine, guanine, melamine, melamine cyanurate, urea, hydantoin, and allantoin, and is preferably guanidine carbonate. The film-forming polymer (B) is selected from the group consisting of urethane, acrylic and melamine-formaldehyde resins, and is preferably a urethane resin. The weight ratio of arc-quenching material (A) and film-forming polymer (B) in the coating composition is about 1:9 to 9:1, preferably 1:4 to 4:1, and even more preferably 7:13 to 13:7.

These and other objects are also accomplished by an arc-quenching composition comprising nitrogen heterocyclic compounds selected from the group of guanidine carbonate, guanidine acetate, 1,3-diphenylguanidine, guanine, melamine cyanurate, urea, hydantoin, or allantoin.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
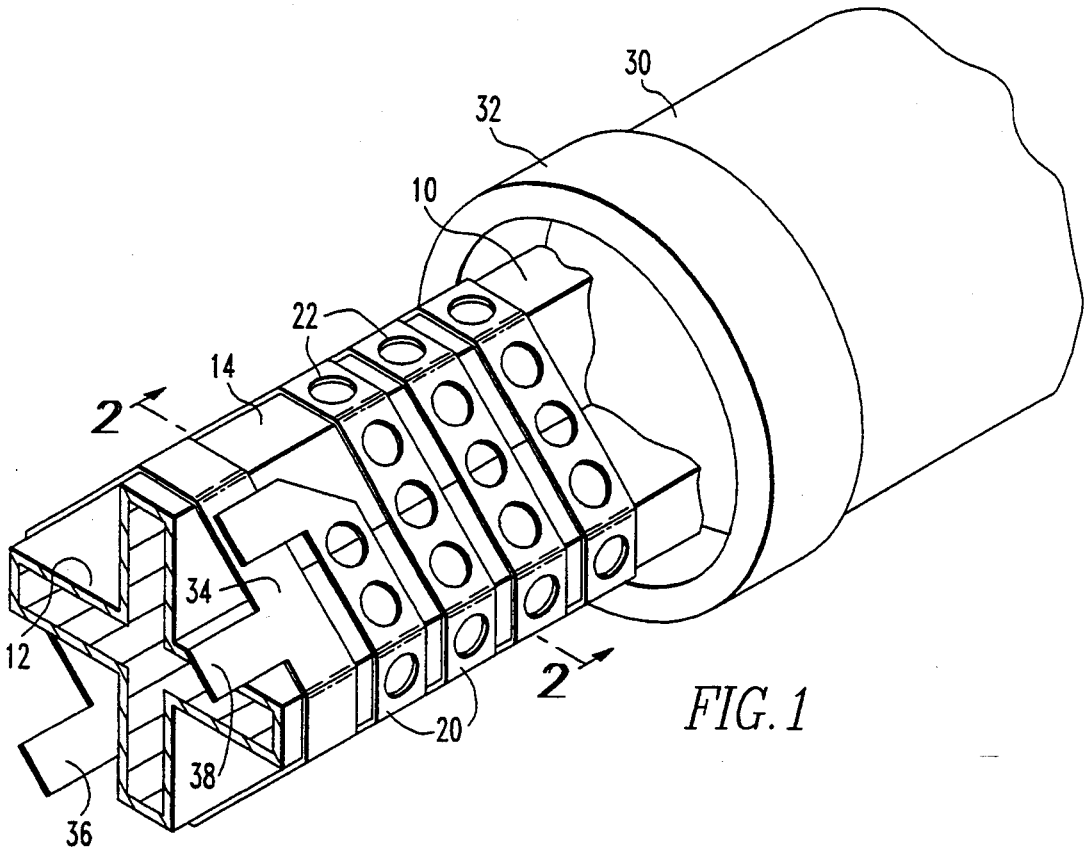
FIG. 1 is a perspective view of a high voltage current limiting fuse having the arc-quenching coating composition according to the invention coated on the surface of the core.

An improved and economical arc-quenching material for circuit interruption devices according to the invention having sufficient structural, gas-evolving, electrical insulation and thermal properties and improved track resistance is provided according to the invention by an arc-quenching coating composition comprising an effective amount by weight of an arc-quenching or gas-evolving material (A) and a film-forming polymer (B) wherein the film-forming polymer (B) has minimal tracking properties and further acts as the liquid vehicle for the coating composition, which can be easily applied by conventional coating techniques to structural members such as the core or the fusible element or elements of a high voltage current limiting device.

The film-forming polymer (B) of the arc-quenching coating composition according to the invention provides sufficient structural stability to the arc-quenching material (A) without jeopardizing the track resistance or non-carbonizing properties of the arc-quenching material (A). Moreover the arc-quenching coating composition according to the invention has excellent arc-extinguishing properties with minimal carbon residue (graphite) formation.

The arc-quenching or gas-evolving material (A) is preferably selected from compounds possessing rapid gas-evolving properties, minimal tracking properties, and high electrically nonconducting properties, insulating properties and thermal properties. The arc-quenching component (A) is preferably high in nitrogen content and low in carbon content to ensure minimal tracking from carbon (graphite) residues formed in the circuit interrupter when exposed to high arcing conditions and high temperatures. More preferably, the arc-quenching component (A) is a nitrogen heterocyclic compound. Even more preferably, carbonates and acetate salts derived from nitrogen heterocyclic compounds are particularly desirable because of their higher thermal stability and good coating properties.

The inventors' have discovered certain arc-quenching components (A) which have not heretofore been taught or suggested and are effective in arc-extinguishing properties. Particularly, the arc-quenching component (A) can comprise guanidine carbonate salts and derivatives thereof having the following general chemical structure:

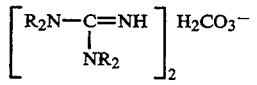

where R=H, alkyl, aryl, aralkyl, and alkaryl groups.

The arc-quenching component (A) can further comprise guanidine acetate salts and derivatives thereof having the following general chemical structure:

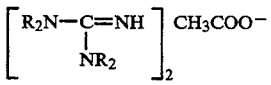

where R=H, alkyl, aryl, aralkyl and alkaryl groups.

The arc-quenching component (A) can further include guanidine and derivatives thereof, preferably 1,3-diphenylguanidine and derivatives thereof having the following general chemical structure:

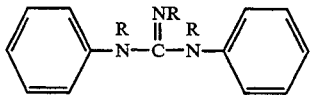

where R=H and alkyl groups.

The arc-quenching component (A) can also comprise guanine and derivatives thereof having the following general chemical structure:

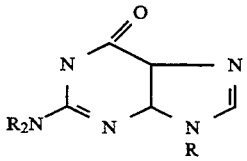

where R=H, alkyl and aryl groups.

The arc-quenching component (A) can also comprise cyanurates and derivatives thereof having the following general chemical structure:

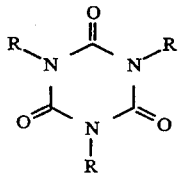

where R=H, alkyl and aryl groups.

The arc-quenching component (A) can also comprise melamine and derivatives thereof, as are already known in the art, having the following general chemical structure:

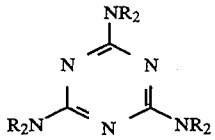

where R=H, alkyl and aryl groups.

Preferably, the melamine and cyanurates are provided together as melamine cyanurates.

The arc-quenching component (A) can further comprise urea and derivatives thereof having the chemical structure:

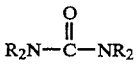

where R=H, alkyl and aryl groups.

The arc-quenching component (A) can further comprise hydantoin and derivatives thereof having chemical structure:

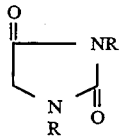

where R=H, alkyl and aryl groups.

The arc-quenching component (A) can further comprise allantoin and derivatives thereof having the chemical structure:

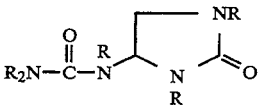

where R=H, alkyl and aryl groups.

Therefore, the arc-quenching component (A) comprises an effective amount of gas-evolving materials including, guanidine carbonate, guanidine acetate, guanidine 1,3-diphenylguanidine, cyanurate, melamine, melamine cyanurate, urea, hydantoin, allantoin, and derivatives and mixtures thereof. These materials provide excellent gas-evolving and non-tracking properties for rapid arc-extinction.

Moreover, the arc-quenching component (A) is preferably a thermally stable composition at 150° C. or higher for prolonged service in fuses or circuit interrupters. More preferably, the arc-quenching component (A) can withstand twenty years of aging at 150° C. without any significant thermal decomposition. Furthermore, the molecular weight of the arc-quenching component (A) is preferably in the range of 60 to 400 grams/mole. In addition, the number of carbon atoms in the R-group positions as described above is preferably in the range of 1 to 10 , more preferably 1 to 3 to minimize carbon tracking, and even more preferably the R-groups are hydrogen.

The arc-quenching material (A) is combined with a film-forming relatively non-tracking polymer (B) which acts as a liquid vehicle to form the arc-quenching coating composition according to the invention. The vehicle acts as a liquid carrier for the arc-quenching material and as a binder to affix the arc-quenching material to the coated substrate. The vehicle is a spreadable liquid and forms a film once coated onto a substrate. The vehicle can dry to a film either by evaporation of water or oxidation and polymerization.

The coating composition formed is relatively high track resistance since the decomposition of the film-forming polymer (B) is relatively clean and does not substantially form carbon residues upon arcing conditions. The coating composition according to the invention may be applied in a liquid carrier or may be solventless. The coating composition can be cured by aft-drying, heat or UV radiation. The coating composition according to the invention is relatively inexpensive to manufacture and apply in the current limiting device which further has high gas-evolving capabilities and improved track resistance properties with minimal carbon residues.

The film-forming minimal tracking polymer (B) which acts as a liquid vehicle for the gas-evolving material (A), acting similar to a paint or ink vehicle, is preferably high in nitrogen content and low in carbon content, which upon decomposition under arcing conditions forms minimal carbon residues and therefore minimal tracking.

Preferably the film-forming polymer (B) is a urethane based resin, a polymer containing —NHCOO— groups as the backbone. The film-forming polymer (B) urethane resin has the following preferred chemical structure:

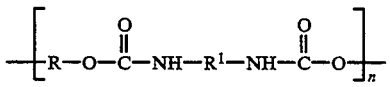

where

R=$CH_3$, $C_2H_5$, $C_3H_7$, $C_4H_9$, $C_6H_5$, alkyl, and aryl; and, $R^1$=$C_6H_4$, $(C_6H_4)_2CH_2$, and $(CH_2)_6$, alkyl and aryl.

The urethane polymer (B) is preferably an air drying film-forming polymer at room temperature, although heat and UV curing is also possible. Commercially available polyurethane resins such as Hysol PC-18 and Hysol PC-29 manufactured by Dexter Hysol, Inc. can be used.

The film-forming polymer (B) can also comprise an acrylic based resin which acts as the vehicle for arc-quenching component (A). Although acrylic resins do not contain nitrogen and are high in carbon, acrylic resins decompose under arcing conditions to its original monomer structure, thereby forming minimal carbon residues and minimal tracking. The film-forming polymer (B) acrylic resin has the following preferred chemical structure:

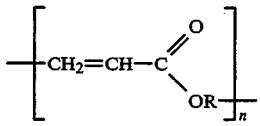

where R=$CH_3$, $C_2H_5$, $C_3H_7$, $C_4H_9$, alkyl and aryl groups. Commercially available acrylic resins such as Hysol PC-20 manufactured by Dexter Hysol, Inc. and Humiseal 1B31 manufactured by Columbia Chase, Inc. can be used.

The film-forming polymer (B) can further comprise melamine-formaldehyde resins.

A solvent or liquid carrier such as toluene, xylene, MEK or the like can also be provided with the fill-forming polymer (B) to provide desirable coating and rheological properties, although a carrier is not necessary. The solids content of film-forming polymer (B) in a carrier is preferably 35 to 65% by weight.

The gas-evolving or arc-quenching component (A) is provided in a range of about 10 to 90% by weight of the coating composition, preferably 20 to 80% by weight, even more preferably 35 to 65% by weight, and the balance film-forming polymer (B). Arc-quenching component (A) can also comprise mixtures of the above mentioned structures. The arc-quenching coating composition has a viscosity preferably in the range of 300 to 900 centipoise, a shelf life of greater than 12 months at ambient temperature, and a cure time of 1 to 4 hours at ambient temperature. In addition, the curing of the arc-quenching coating may be enhanced by synergistic cross-linking between the arc-quenching component (A) and fill-forming polymer (B) which enhances the thermal stability of the composition without decreasing the arc-quenching properties.

The arc-quenching coating composition can also include a track resistant additive (C) such as hydrated alumina, calcium carbonate, boric acid, magnesium hydroxide or the like. However, the use of a track resistant additive (C) that releases water during arcing conditions can cause corrosion damage to the fuse components and, therefore, is not preferred.

Figure 2:
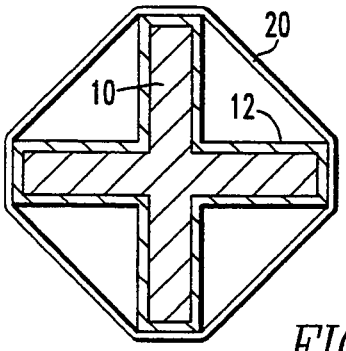
FIG. 2 is a cross-sectional view of the coated core along 1—1 of FIG. 1.

The arc-quenching coating composition according to the invention can be used to coat the core, i.e., the support for fusible element or elements, in a high voltage current limiting fuse as shown in FIGS. 1 and 2. FIG. 1 is a perspective view of a high voltage current limiting fuse having the arc-quenching composition according to the invention coated on the surface of the core.

FIG. 1 shows, generally, a high voltage current limiting fuse 1. The high voltage current limiting fuse 1 includes a core or support means 10 having fusible element or elements 20 electrically connected in parallel and wrapped about the core 10. The core 10 and the fusible element 20 are typically located within a tubular insulating casing 30. The tubular casing 30 is typically made of an insulating material such as glass reinforced epoxy. A pair of metal caps or ferrules 32 are attached to the opposite ends of the tubular casing 30 by suitable means closing each of the opposite ends of the tubular casing 30, and are typically made of an electrically conductive material such as copper. The metal caps 32 provide the electrical interconnection means between the fusible element 20 and an external circuit.

A pair of electrically conductive terminal rings 34 are attached to the opposite ends of the core 10 by suitable means. The fusible element 20 is electrically attached to the terminal rings 34 by suitable means such as by welding, soldering or the like. The terminal rings 34 further contain electrically conductive tabs 36, 38 that are conductively attached to the metal cap 32 by suitable means such as by welding, soldering or the like, to provide an electrical interconnection between the fusible element 20 and the metal cap 32. A pulverulent arc-quenching filler material, not shown, such as sand, mica beads or the like, can be located inside the tubular casing 30.

The fusible element 20 is typically in a ribbon-type form and made of high conductivity material such as silver. The fusible element 20 can also be a plurality of fusible elements. The fusible element 20 typically contains a plurality of perforations 22 to provide a plurality of reduced cross-sections which under fault current conditions are well known to facilitate the vaporization of the fusible element. A detailed description of the construction and materials for current limiting fuses are taught in U.S. Pat. Nos. 4,319,212 (Leach.), 4,339,742 (Leach et al.), and 4,099,153 (Cameron), which are incorporated by reference herein.

The surface of the core 10 as shown in FIG. 1 is coated with an effective amount of arc-quenching composition 12 according to the invention. The core 10 is further structurally shaped to have a cross-shaped cross-section as shown in FIG. 2 which includes generally radial projecting fins 14 that extend longitudinally and axially along the length of the core. The fin design can either be star-shaped (not shown), cross-shaped or the like which is well known to be a desirable configuration since it reduces the contact area between the fusible elements and the core to improve performance. The arc-quenching coating composition according to the invention can be provided as a coating by well-known coating techniques, for example, by spraying, brushing, painting, immersing or the like, on portions of the core or on the entire core as shown in FIGS. 1 and 2. A detailed description of various coating techniques is provided in Zink, et al., "Coating Processes", Kirk-Othmer Concise Encyclopedia of Chemical Technology, pp. 292–294, John Wiley & Sons, Inc., 1985, incorporated by reference herein.

Figure 3:
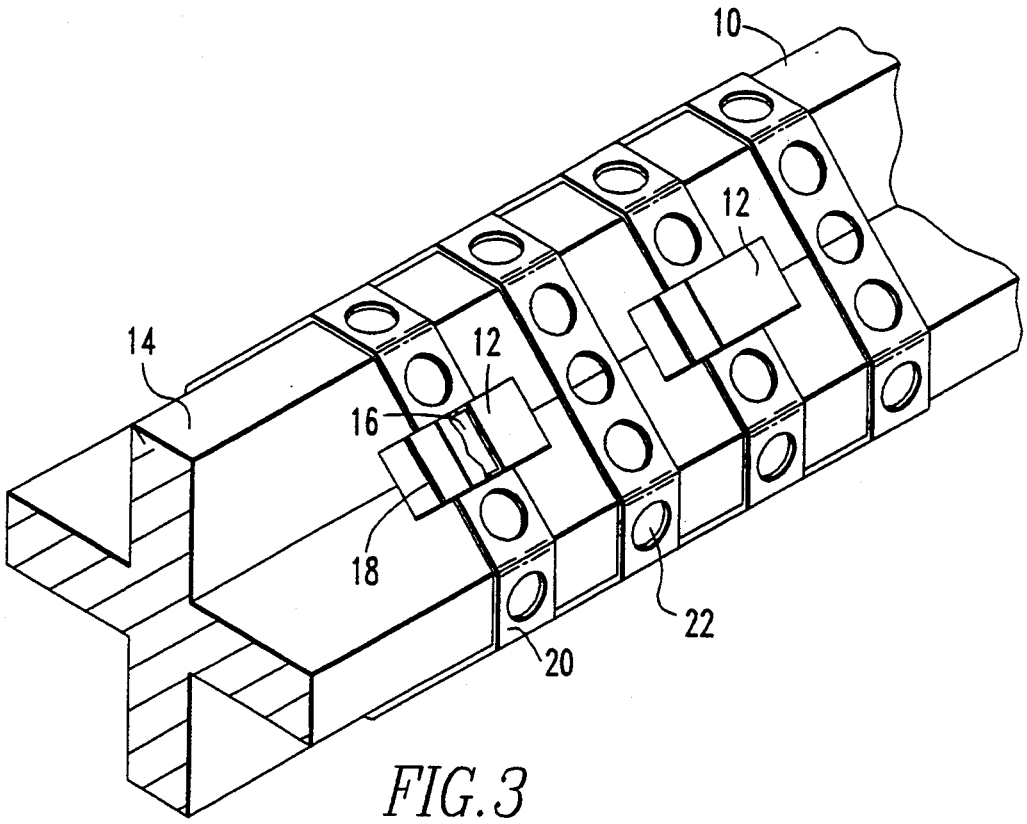
FIG. 3 is a perspective view of a high voltage current limiting fuse having the arc-quenching coating composition according to the invention coated on a polymeric self-sustaining structural material positioned over the fusible elements.

As shown in FIG. 3, the arc-quenching coating composition according to the invention can also be used to coat separate self-sustaining structural materials 16, which also may contain arc-quenching or gas-evolving additives, the self-sustaining structures having slits 18 as shown that are distributed along the length of the core 10 and positioned with slits 18 over the width of the fusible element 20 and in operative engagement with portions of the fusible element 20. The arc-quenching coating composition can also be applied directly to the fusible element or elements, not shown. The arc-quenching coating composition can further be applied to gas-evolving structures already present in a circuit interrupter to provide enhanced track resistance.

It has been found advantageous to have the coating composition according to the invention applied to gas-evolving self-sustaining structural materials used as, for example, the core in the high voltage, current limiting device. It has been found particularly advantageous to coat a self-sustaining arc-quenching material that has been formulated with organic polymeric binders for maintaining structural integrity but now contains relatively high carbonizing materials and, therefore, has relatively low track resistance properties. The polymeric structural material may also contain gas-evolving additives. The arc-quenching coating composition according to the invention can be applied in an effective amount over at least a portion of such a highly carbonizing organic material to provide improved track resistance properties to the organic polymeric structural material and which is also effective to extinguish the arc.

The following examples are illustrative of the arc-quenching coating composition according to the invention:

EXAMPLE 1

Figure 4:
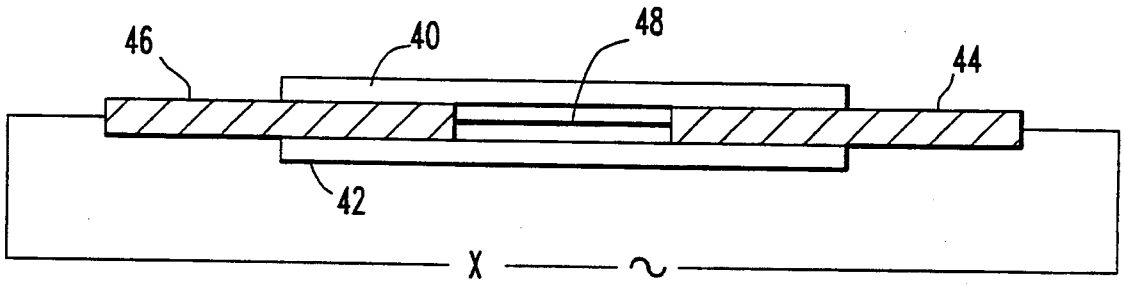
FIG. 4 is an illustration of the test device used to determine the arc-quenching abilities of the arc-quenching coating composition according to the invention.

A test procedure using a test apparatus shown in FIG. 4 was developed to evaluate the various arc-quenching coating compositions according to the invention for arc-quenching effectiveness. The various arc-quenching compositions were coated on a laminate material, namely a glass-filled thermoset polyester which is conventional core material in an expulsion fuse. Two horizontal sample plates 40, 42 comprising a laminate material having a painted surface coating of the arc-quenching coating composition material according to the invention are positioned in parallel-spaced arrangement having a gap between the sample plates of ⅛". Two tungsten wire electrodes 44, 46 were positioned at each open end of the spaced sample plates to close the ends of the sample plates. A copper wire 48 was positioned within the sample plate gap and interconnects the tungsten electrodes 44, 46. The tungsten electrodes were also insulated from the sample plates by fish paper to avoid surface conductivity effects. The gap between the electrodes was set to 0.275" and is initially shorted by the 0.005" diameter Cu wire. A circuit voltage of 880 volts and impedance to give a current of about 30 amps and a power factor of about 0.5 was applied to the same plates.

A guanidine carbonate and urethane arc-quenching coating composition was prepared by mixing about 50% by weight guanidine with about 50% by weight urethane resin, namely Hysol PC-18 polyurethane resin. The arc-quenching coating composition was painted onto the surface of a red polyester laminate material. A voltage was applied to cause arcing and arcing time was 100 milliseconds. Hysol PC-29 and Hysol PC-20 could also have been used. The coating also protected the laminate beneath it by extinguishing the arc before any damage to the underlying laminate occurred.

EXAMPLE 2

A guanine and urethane arc-quenching coating composition was prepared by mixing 50% by weight guanine and 50% by weight urethane, namely Hysol PC-18 polyurethane resin. The arc-quenching coating composition was painted onto the surface of the red polyester laminate material. A voltage was applied to cause arcing and the arcing time was 75 milliseconds. The coating also protected the laminate beneath it by extinguishing the arc before any damage to the underlying laminate occurred.

EXAMPLE 3

A melamine cyanurate and urethane arc-quenching coating composition was prepared by mixing 50% by weight melamine cyanurate and 50% by weight urethane, namely Hysol PC-18 polyurethane resin. The arc-quenching coating composition was painted onto the surface of a grey polyester laminate material. A voltage was applied to cause arcing and the arcing time was 1.25 milliseconds. The coating also protected the laminate beneath it by extinguishing the arc before any damage to the underlying laminate occurred.

EXAMPLE 4

An arc-quenching glass-filled red polyester laminate was provided as the sample without an arc-quenching coating composition on the surface thereof. A voltage was applied to cause arcing and the arcing time was 550 milliseconds.

EXAMPLE 5

An arc-quenching glass-filled grey polyester laminate was provided as the sample without an arc-quenching coating composition applied on the surface thereof. A voltage was applied to cause arcing and the arcing time was 630 milliseconds.

EXAMPLE 6

An arc-quenching black urea-formaldehyde laminate was provided as the sample without an arc-quenching coating composition applied on the surface thereof. A voltage was applied to cause arcing and the arcing time was 380 milliseconds.

EXAMPLE 7

An arc-quenching white urea-formaldehyde laminate was provided as the sample without an arc-quenching coating composition applied on the surface thereof. A voltage was applied to cause arcing and the arcing time was 200 milliseconds.

EXAMPLE 8

An arc-quenching polyacetal copolymer laminate was provided as the sample without an arc-quenching coating composition applied on the surface thereof. A voltage was applied to cause arcing and the arcing time was 550 milliseconds.

EXAMPLE 9

The guanidine carbonate and urethane arc-quenching coating composition of Example 1 was tested in a 5.5 KV-Type CX fuse by painting it directly on the metallic fuse elements over the middle third of the fuse length and also painting it on the ceramic support rods or core over the total length. Comparative tests were run with identical fuses not containing gas-evolving coatings. The results obtained indicated that fuses containing the coating composition exhibited more effective arc-quenching behavior than an uncoated core or fuse elements.

EXAMPLE 10

Three arc-quenching coating compositions were prepared by mixing the following: (1) 50% by weight urea and 50% by weight urethane; (2) 50% by weight hydantoin and 50% by weight urethane; and, (3) 50% by weight allantoin and 50% by weight urethane. The urethane used was Hysol PC-18 polyurethane resin. The three arc-quenching coating compositions were tested separately in a 5.5 KV-Type CX fuse by painting them directly on the metallic fuse elements over the middle third of the fuse length and also painting them on the ceramic support rods or core over the total length. The arc-quenching coating compositions had an arcing time of 15, 45 and 40 milliseconds, respectively. The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive fights are claimed.

We claim:

1. An arc-quenching coating composition, comprising:

(A) an effective amount of an arc-quenching gas-evolving material selected from the group consisting of guanidine carbonate, guanidine acetate, 1,3-diphenylguanidine, guanine, melamine cyanurate, urea, hydantoin, and allantoin; and, (B) a film-forming polymer comprising a urethane resin, wherein the film-forming polymer (B) acts as a liquid vehicle for applying the arc-quenching material (A) as a coating composition.

2. The arc-quenching coating composition according to claim 1, further comprising an arc-quenching gas-evolving material (C) selected from the group consisting of hydrated alumina, boric acid, calcium carbonate,, magnesium hydroxide.

3. The arc-quenching coating composition according to claim 1, wherein the coating composition comprises about 10 to 90% by weight of the arc-quenching gas-evolving material (A) and 90 to 10% by weight of the film-forming polymer (B).

4. The arc-quenching coating composition according to claim 3, wherein the coating composition comprises about 35 to 65% by weight of the arc-quenching gas-evolving material (A) and 65 to 35% by weight of the film-forming polymer (B).

5. A high voltage current limiting fuse, comprising:

a generally tubular casing of electrically insulating material; a pair of terminal elements closing each of the opposite ends of said casing; at least one fusible element conductively interconnecting said pair of terminal elements; a core for supporting said at least one fusible element, wherein said core includes at least one support element longitudinally extending parallel to the longitudinal axis of said casing; and, wherein at least one of the fusible element, core, or casing has at least a portion of the surface thereof coated with an effective amount of an arc-quenching coating composition, said arc-quenching coating composition comprising (A) an effective amount of an arc-quenching gas-evolving material selected from the group consisting of guanidine carbonate, guanidine acetate, 1,3-diphenylguanidine, guanine, melamine cyanurate, urea, hydantoin and allantoin, and (B) a film-forming polymer comprising a urethane resin, wherein the film-forming polymer (B) acts as a liquid vehicle for applying the arc-quenching material (A) as a coating composition.

6. The arc-quenching coating composition according to claim 1, wherein the arc-quenching gas-evolving material (A) comprises guanidine carbonate.

7. The arc-quenching coating composition according to claim 1, wherein the arc-quenching gas-evolving material (A) comprises guanidine acetate.

8. The arc-quenching coating composition according to claim 1, wherein the arc-quenching gas-evolving material (A) comprises 1,3-diphenylguanidine.

9. The arc-quenching coating composition according to claim 1, wherein the arc-quenching gas-evolving material (A) comprises guanine.

10. The arc-quenching coating composition according to claim 1, wherein the arc-quenching gas-evolving material (A) comprises melamine cyanurate.

11. The arc-quenching coating composition according to claim 1, wherein the arc-quenching gas-evolving material (A) comprises urea.

12. The arc-quenching coating composition according to claim 1, wherein the arc-quenching gas-evolving material (A) comprises hydantoin.

13. The arc-quenching coating composition according to claim 1, wherein the arc-quenching gas-evolving material (A) comprises allantoin.

14. The arc-quenching coating composition according to claim 1, wherein the film-forming polymer (B) comprises a polyurethane resin.

15. The arc-quenching coating composition according to claim 1, wherein the film-forming polymer (B) further comprises a solvent.

16. The arc-quenching coating composition according to claim 1, wherein the coating composition is cured in air at ambient temperature.

17. The high voltage current limiting fuse according to claim 5, wherein the arc-quenching gas-evolving material (A) of the arc-quenching coating composition comprises guanine.

18. The high voltage current limiting fuse according to claim 17, wherein the film-forming polymer (B) of the arc-quenching coating; composition comprises a polyurethane resin.

19. The high voltage current limiting fuse according to claim 18, wherein the arc-quenching coating composition comprises about 35 to 65% by weight of the arc-quenching gas-evolving material (A) and 65 to 35% by weight of the film-forming polymer (B).

20. The high voltage current limiting fuse according to claim 5, further comprising a pulverulent arc-quenching filler material filled inside the tubular casing.

* * * * *